US011833699B2

(12) United States Patent
Petrelli

(10) Patent No.: US 11,833,699 B2
(45) Date of Patent: Dec. 5, 2023

(54) HAND-HELD APPLIANCE WITH IMPROVED COUPLING STRUCTURE FOR A FUNCTIONAL ATTACHMENT OF THE APPLIANCE

(71) Applicant: KONINKLIJKE PHILIPS N.V., Eindhoven (NL)

(72) Inventor: Marcus Cornelis Petrelli, Groningen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 399 days.

(21) Appl. No.: 17/278,458

(22) PCT Filed: Oct. 14, 2019

(86) PCT No.: PCT/EP2019/077675
§ 371 (c)(1),
(2) Date: Mar. 22, 2021

(87) PCT Pub. No.: WO2020/083674
PCT Pub. Date: Apr. 30, 2020

(65) Prior Publication Data

US 2021/0347074 A1 Nov. 11, 2021

(30) Foreign Application Priority Data

Oct. 23, 2018 (EP) ..... 18201887

(51) Int. Cl.
*B26B 19/14* (2006.01)
*B26B 19/28* (2006.01)
*B26B 19/38* (2006.01)

(52) U.S. Cl.
CPC ..... *B26B 19/145* (2013.01); *B26B 19/28* (2013.01); *B26B 19/386* (2013.01)

(58) Field of Classification Search
CPC ..... B26B 19/3853; B26B 19/14; B26B 19/06; B26B 19/28; B26B 19/145; B26B 19/386; B26B 19/141; B26B 19/063
(Continued)

(56) References Cited

U.S. PATENT DOCUMENTS 2,536,015 A * 12/1950 Konrad ..... B26B 19/14 30/346.51
3,447,241 A * 6/1969 Moeckl ..... B26B 19/382 30/41
(Continued)

FOREIGN PATENT DOCUMENTS

CN 203458484 3/2014
DE 9104026 6/1991
(Continued)

OTHER PUBLICATIONS

International Search Report and Written Opinion dated Nov. 19, 2019 For International Application No. PCT/EP2019/077675 Filed Oct. 14, 2019.

*Primary Examiner* — Dariush Seif

(57) ABSTRACT

The invention relates to a coupling structure (8, 9, 10) for coupling a drive shaft (6) of a main body (2) of a hand-held appliance (1) to a driven part (7) of a releasable functional attachment (3) of the hand-held appliance (1). The coupling structure comprises a coupling bush (8), a coupling head (9) and a coupling spring (10). The coupling head (9) is axially fixed within the functional attachment (3), the coupling bush (8) is axially displaceable within the main body (2). The coupling spring (10) is housed in the main body (2) and urges displacement of the coupling bush (8) towards the coupling head (9), when the functional attachment (3) is attached to the main body (2). The coupling structure is
(Continued)

compact, especially in the axial direction of the coupling structure, and especially within the functional attachment.

5 Claims, 7 Drawing Sheets

(58) Field of Classification Search
USPC .... 30/43.6, 43.92, 216, 346.51, 210, 45, 42, 30/43.4, 43.5
See application file for complete search history.

(56) References Cited

U.S. PATENT DOCUMENTS 3,813,774 A * 6/1974 Cobarg ..... B26B 19/12 30/43.9
3,890,705 A * 6/1975 Tietjens ..... B26B 19/14 30/43.6
4,137,629 A * 2/1979 Yamazaki ..... B26B 19/14 30/43.5
4,223,437 A * 9/1980 Boiten ..... B26B 19/141 30/346.51
4,240,199 A * 12/1980 Boiten ..... B26B 19/141 30/346.51
4,257,161 A * 3/1981 Bijl ..... B26B 19/14 464/158
4,275,497 A * 6/1981 Engelhardt ..... B26B 19/141 30/34.2
4,283,849 A * 8/1981 Engelhardt ..... B26B 19/141 30/43.6
4,329,781 A * 5/1982 Schemmann ..... B26B 19/141 30/34.2
4,675,998 A * 6/1987 Thijsse ..... B26B 19/141 30/34.2
5,031,315 A * 7/1991 Labrijn ..... B26B 19/48 30/44
5,165,173 A * 11/1992 Miller ..... B23D 51/10 30/392
5,504,961 A * 4/1996 Yang ..... A61C 17/3436 464/182
5,983,502 A * 11/1999 Geertsma ..... B26B 19/14 30/43.6
6,082,003 A * 7/2000 Douven ..... B26B 19/141 30/346.51
6,219,920 B1 * 4/2001 Klein ..... B26B 19/048 30/346.51
6,722,038 B2 * 4/2004 Visman ..... B26B 19/141 464/106
7,370,420 B2 * 5/2008 Shimizu ..... B26B 19/145 30/346.51
7,530,171 B2 * 5/2009 Baron ..... B26B 19/14 30/346.51
7,743,508 B2 * 6/2010 Shimizu ..... B26B 19/14 30/346.51
8,230,601 B2 * 7/2012 Shimizu ..... B26B 19/145 30/43.6
9,592,614 B2 * 3/2017 Oosterhoff ..... B26B 19/146
10,279,492 B2 * 5/2019 Phoon ..... B26B 19/28
2006/0048390 A1 * 3/2006 Baron ..... B26B 19/28 30/43.6
2006/0156548 A1 * 7/2006 Shimizu ..... B26B 19/143 30/346.51
2006/0179658 A1 * 8/2006 Nakano ..... B26B 19/143 30/43.6
2006/0179659 A1 * 8/2006 Nakano ..... B26B 19/143 30/43.6
2006/0179660 A1 * 8/2006 Nakano ..... B26B 19/3846 30/43.6
2007/0084059 A1 * 4/2007 Hannan ..... B26B 19/145 30/43.5
2008/0016690 A1 * 1/2008 Veenstra ..... B26B 19/145 30/32
2008/0092392 A1 * 4/2008 Shimizu ..... B26B 19/145 30/43.5
2010/0058594 A1 * 3/2010 Westerhof ..... B26B 19/145 30/42
2016/0052153 A1 * 2/2016 Oosterhoff ..... B26B 19/146 30/43.6
2017/0120466 A1 * 5/2017 Phoon ..... B26B 19/28
2017/0144317 A1 * 5/2017 Shimizu ..... B26B 19/3893
2019/0143546 A1 * 5/2019 Peters ..... B26B 19/141 30/34.05
2019/0337171 A1 * 11/2019 Lap ..... B26B 19/145
2020/0094424 A1 * 3/2020 Chan ..... B26B 19/145

FOREIGN PATENT DOCUMENTS

JP S57106045 A 7/1982
WO 2004/065078 8/2004
WO 2008/062339 5/2008

* cited by examiner

HAND-HELD APPLIANCE WITH IMPROVED COUPLING STRUCTURE FOR A FUNCTIONAL ATTACHMENT OF THE APPLIANCE

CROSS REFERENCE TO RELATED APPLICATIONS

This application is the U.S. National Phase application under 35 U.S.C. § 371 of International Application No. PCT/EP2019/077675 filed Oct. 14, 2019, which claims the benefit of European Patent Application Number 18201887.9 filed Oct. 23, 2018. These applications are hereby incorporated by reference herein.

FIELD OF THE INVENTION

The invention relates to a hand-held appliance, such as for example an electric tooling device or a personal care device, according to the pre-characterizing portion of the appended independent claim 1.

Hence, the invention relates to a hand-held appliance comprising a main body and a functional attachment, wherein:

- the hand-held appliance has an attached condition in which the functional attachment is releasably attached to the main body;
- the main body houses a motor and a drive shaft and comprises a hand-gripping area for manually holding the hand-held appliance;
- the functional attachment houses a driven part and a functional structure for performing a functionality of the hand-held appliance;
- the hand-held appliance comprises a coupling structure for coupling the drive shaft and the driven part for mutual co-rotation;
- a coupled condition of said coupling structure is defined as a condition, in which the hand-held appliance is in said attached condition, and in which the coupling structure couples the drive shaft and the driven part for mutual co-rotation;
- an uncoupled condition of said coupling structure is defined as a condition, in which the coupling structure does not couple the drive shaft and the driven part for mutual co-rotation;
- an operation condition of the hand-held appliance is defined as a condition, in which the coupling structure is in said coupled condition, and in which the motor drives the drive shaft, while at the same time the drive shaft drives the driven part in mutual co-rotation, while at the same time the driven part drives the functional structure of the functional attachment;
- the coupling structure comprises a coupling bush, a coupling head and a coupling spring, wherein the main body houses the coupling bush, and wherein the functional attachment houses the coupling head;
- the coupling bush and the drive shaft are coupled for mutual co-rotation, and the coupling head and the driven part are coupled for mutual co-rotation;
- said mutual co-rotation of the drive shaft and the driven part in said operation condition of the hand-held appliance is realized in that in said coupled condition of the coupling structure the coupling head is at least partly inserted via an axial end of the coupling bush into an interior space of the coupling bush, while in said interior space there is co-rotating coupling between the coupling bush and the coupling head; and

- in said attached condition of the hand-held appliance, the coupling spring urges relative displacement of one of the coupling head and the coupling bush towards the other of the coupling head and the coupling bush, so as to effectuate said coupled condition from said uncoupled condition when the motor drives the drive shaft, and so as to maintain said coupled condition when the motor drives the drive shaft.

BACKGROUND OF THE INVENTION

Hand-held appliances of the type as initially identified above are known from practice. FIGS. 2, 3A-3B, 4A-4B in the enclosed drawing are illustrating such a hand-held appliance known from the prior art.

The reference signs used in FIGS. 2, 3A-3B, 4A-4B are referring to the abovementioned parts and aspects of the hand-held appliance known from the prior art, as well as to related parts and aspects, in the following manner.

101 hand-held appliance
102 main body of hand-held appliance 101
103 functional attachment of hand-held appliance 101
104 hand-gripping area of main body 102
105 functional structure of functional attachment 103
106 drive shaft
107 driven part
107A connection collar of driven part 107
107B axial slot of the connection collar 107A
108 coupling bush
108A connection collar of coupling bush 108
109 coupling head
109A radial protrusion of the coupling head 109
110 coupling spring
116 rotation axis of drive shaft 106
117 rotation axis of driven part 107
127 pivot pin for driven part 107

Based on the above introductory description, and based on the above-explained reference signs, the shown example of FIGS. 2, 3A-3B, 4A-4B is for the greatest part readily self-explanatory. The following extra explanations are given.

In the cross-sectional perspective view of FIG. 2 the known hand-held appliance 101 is shown in a condition in which the functional attachment 103 has been released from the main body 102 of the hand-held appliance 101. The shown hand-held appliance 101 is a shaving device, wherein the functional structure 105 of the functional attachment 103 comprises two hair-cutting units 105, only one of which is shown in FIG. 2. The cross-sectional view of FIG. 2 further reveals at least the drive shaft 106, the coupling bush 108, the coupling head 109, the coupling spring 110, the driven part 107, and the pivot pin 127 for the driven part 107. In FIG. 2 the coupling structure 108, 109, 110 is in its uncoupled condition.

FIGS. 3A-3B show a side view and a cross-sectional view, respectively, of the coupling structure 108, 109, 110 together with the driven part 107. The driven part 107 is a gear wheel, wherein the connection collar 107A is an integrally manufactured part of the gear wheel.

FIGS. 4A-4B show the coupling structure 108, 109, 110 in a comparable, but more schematic cross-sectional view as compared to FIG. 3B. FIGS. 4A-4B further show the drive shaft 106. It is noted that the coupling bush 108 is fixedly attached, via its connection collar 108A, to the drive shaft 106 in a co-rotatable manner about the rotation axis 116.

The coupling spring 110 is held in-between the driven part 107 and the coupling head 109. Both the coupling head 109 and the coupling spring 110 are coupled to the driven part 107 in a co-rotatable manner about the rotation axis 117. These co-rotatabilities are realized in that the radial protrusions 109A of the coupling head 109 are extending into the axial slots 107B of the connection collar 107A of the driven part 107.

Said axial slots 107B of the connection collar 107A, and said radial protrusions 109A of the coupling head 109, have the additional function to allow the coupling head 109 to axially displace relative to the driven part 107.

The coupled condition of the known coupling structure 108, 109, 110 is shown in FIGS. 3A-3B. The coupled condition of the coupling structure 108, 109, 110 requires that the functional attachment 102 (see FIG. 2) is attached to the main body 103 (see FIG. 2). The coupled condition of the coupling structure 108, 109, 110 additionally requires that the coupling head 109 is at least partly inserted via an axial end of the coupling bush 108 into an interior space of the coupling bush 108, while in said interior space there is co-rotating coupling between the coupling bush 108 and the coupling head 109. In the coupling structure 108, 109, 110 said co-rotating coupling in said interior space is realized in that the circumference of the outer side of the coupling head 109 has a polygonal shape, which mates with the polygonal shape of the circumference of the inner side of the coupling bush 108, as seen in cross-section transverse to the rotation axes 116, 117.

Both FIG. 4A and FIG. 4B relate to a situation in which the functional attachment 102 is attached to the main body 103. The difference between the two figures, however, is that in FIG. 4A the coupling structure 108, 109, 110 is in the uncoupled condition, while in FIG. 4B it is in the coupled condition. That is, in FIG. 4A the coupling head 109 does not yet extend into the interior space of the coupling bush 108 for co-rotative coupling between the coupling bush 108 and the coupling head 109, due to misalignment of the above-mentioned mating polygonal shapes of the coupling head 109 and the coupling bush 108. In fact, FIG. 4A relates to a situation immediately after a user has attached the functional attachment 102 to the main body 103, after which the motor has not yet been started to drive the drive shaft 106. As soon as the user starts the motor, said misalignment will automatically be cancelled under influence of the coupling spring 110, which urges displacement of the coupling head 109 into the interior space of the coupling bush 108, whereby the coupled condition shown in FIG. 4B is obtained.

From FIGS. 2, 3A-3B, 4A-4B it will now be clear that the known hand-held appliance 101 has the following features:

- within the functional attachment 103 the coupling head 109 is axially displaceable relative to the driven part 107, as seen along the rotation axis 117 of the driven part 107;
- within the main body 102 the coupling bush 108 has an axially fixed position relative to the drive shaft 106, as seen along the rotation axis 116 of the drive shaft 106; and
- the functional attachment 103 houses the coupling spring 110, wherein the coupling spring 110 urges displacement of the coupling head 109 relative to the driven shaft 107 for effectuating and maintaining the coupled condition of the coupling structure 108, 109, 110 when the motor drives the drive shaft 106 in the attached condition of the hand-held appliance.

A drawback of this known hand-held appliance 101 is that its coupling structure is relatively spacious, especially in view of the relatively large axial length of the coupling structure 108, 109, 110.

It is noted that WO 2008/062339 A1 discloses a hand-held appliance, which is more or less similar to the above described known hand-held appliance 101. See WO 2008/062339 A1, FIG. 5A, in which the reference numerals 4, 2, 22 are indicating parts which are similar to the main body 102, the functional attachment 103, and the coupling head 109, respectively, as described above. FIG. 5A of WO 2008/062339 A1 further shows a coupling spring similar to the coupling spring 110 described above. A corresponding coupling bush, however, is not explicitly shown in WO 2008/062339 A1.

SUMMARY OF THE INVENTION

It is an object of the invention to provide a reliable coupling structure for coupling a drive shaft of a main body of a hand-held appliance with a driven part of a functional attachment of the hand-held appliance, wherein the coupling structure can be designed more compact, especially in the axial direction of the coupling structure, and especially within the functional attachment of the hand-held appliance.

For that purpose the invention provides a hand-held appliance according to the appended independent claim 1. Preferable embodiments of the invention are provided by the appended dependent claims 2-5.

Hence, the invention provides a hand-held appliance comprising a main body and a functional attachment, wherein:

- the hand-held appliance has an attached condition in which the functional attachment is releasably attached to the main body;
- the main body houses a motor and a drive shaft and comprises a hand-gripping area for manually holding the hand-held appliance;
- the functional attachment houses a driven part and a functional structure for performing a functionality of the hand-held appliance;
- the hand-held appliance comprises a coupling structure for coupling the drive shaft and the driven part for mutual co-rotation;
- a coupled condition of said coupling structure is defined as a condition, in which the hand-held appliance is in said attached condition, and in which the coupling structure couples the drive shaft and the driven part for mutual co-rotation;
- an uncoupled condition of said coupling structure is defined as a condition, in which the coupling structure does not couple the drive shaft and the driven part for mutual co-rotation;
- an operation condition of the hand-held appliance is defined as a condition, in which the coupling structure is in said coupled condition, and in which the motor drives the drive shaft, while at the same time the drive shaft drives the driven part in mutual co-rotation, while at the same time the driven part drives the functional structure of the functional attachment;
- the coupling structure comprises a coupling bush, a coupling head and a coupling spring, wherein the main body houses the coupling bush, and wherein the functional attachment houses the coupling head;
- the coupling bush and the drive shaft are coupled for mutual co-rotation, and the coupling head and the driven part are coupled for mutual co-rotation;

said mutual co-rotation of the drive shaft and the driven part in said operation condition of the hand-held appliance is realized in that in said coupled condition of the coupling structure the coupling head is at least partly inserted via an axial end of the coupling bush into an interior space of the coupling bush, while in said interior space there is co-rotating coupling between the coupling bush and the coupling head; and in said attached condition of the hand-held appliance, the coupling spring urges relative displacement of one of the coupling head and the coupling bush towards the other of the coupling head and the coupling bush, so as to effectuate said coupled condition from said uncoupled condition when the motor drives the drive shaft, and so as to maintain said coupled condition when the motor drives the drive shaft;

characterized in that:

within the functional attachment the coupling head has an axially fixed position relative to the driven part, as seen along a rotation axis of the driven part;

within the main body the coupling bush is axially displaceable relative to the drive shaft, as seen along a rotation axis of the drive shaft; and the main body houses the coupling spring, wherein the coupling spring urges displacement of the coupling bush relative to the drive shaft for said effectuating and said maintaining said coupled condition of the coupling structure when the motor drives the drive shaft in the attached condition of the hand-held appliance.

Hence, the hand-held appliance according to the invention differs from the known hand-held appliance of FIGS. 2, 3A-3B, 4A-4B in that for the hand-held appliance according to the invention:

the coupling head is axially fixed within the functional attachment (instead of being axially displaceable within the functional attachment, as is the case for said known hand-held appliance);

the coupling bush is axially displaceable within the main body (instead of being axially fixed within the main body as is the case for said known hand-held appliance); and the coupling spring is housed in the main body (instead of in the functional attachment, as is the case for said known hand-held appliance).

Thanks to the coupling head being axially fixed within the functional attachment, and thanks to the coupling spring being housed in the main body, the coupling structure is more compact, especially in the axial direction of the coupling structure, and especially within the functional attachment of the hand-held appliance.

In a preferable embodiment of the invention said axial displaceability of the coupling bush relative to the drive shaft is realized in that the coupling bush and the drive shaft are interconnected in mutual telescoping engagement.

The fact that the coupling bush, and not the coupling head, is the axially displaceable part of the coupling structure, and the fact that the coupling bush is in said telescoping engagement with the drive shaft, together allow for a more compact structure to realize said axial displaceability for realizing the transition between the uncoupled condition and the coupled condition, and vice versa, as compared to the case wherein the coupling head would be in telescoping engagement with the driven part. In particular, the telescopic engagement of the coupling bush with the drive shaft and the fact that the coupling bush comprises the interior space for receiving the coupling head in said coupled condition of the coupling structure, together result in a reduced overall dimension of the coupling structure in said coupled condition, as seen in an axial direction parallel to the rotational axes of the drive shaft and the driven part. At the same time the axially displaceable coupling bush allows for a reliable co-rotating coupling between the drive shaft and the coupling bush, on the one hand, and, simultaneously therewith, between the coupling bush and the coupling head, on the other hand. In other words, the telescoping engagement between the coupling bush and the drive shaft further contributes to obtaining compact overall dimensions of the coupling structure in combination with high reliability of the coupling structure.

In another preferable embodiment of the invention, as seen in cross-sections transverse to the rotation axis of the drive shaft:

a first circumference of an inner side of the coupling bush has a first non-circular shape, such as for example a first polygonal shape;

a second circumference of an outer side of the drive shaft has a second non-circular shape, such as for example a second polygonal shape, wherein said second non-circular shape mates with said first non-circular shape for realizing said co-rotating coupling between the coupling bush and the drive shaft; and a third circumference of an outer side of the coupling head has a third non-circular shape, such as for example a third polygonal shape, wherein said third non-circular shape mates with said first non-circular shape for realizing said co-rotating coupling between the coupling bush and the coupling head.

Thanks to the fact that, in the telescopic engagement between the coupling bush and the drive shaft, the same first non-circular shape of the first circumference of the inner side of the coupling bush mates with both the second and third non-circular shapes of the second and third circumferences of the outer sides of the drive shaft and the coupling head, respectively, a considerable space saving is obtained as compared to the known hand-held appliance of FIGS. 2, 3A-3B, 4A-4B, said considerable space saving occurring in regards of the overall axial length of the full coupling structure in the attached condition of the hand-held appliance, i.e. along both the main body and the functional attachment. One of the advantages of the axial space saving is that it allows to bring the functional structure of the functional attachment considerably closer to the hand-gripping area of the main body, which gives the user of the hand-held appliance more control.

In another preferable embodiment of the invention, said second non-circular shape is the same as said third non-circular shape.

In another preferable embodiment of the invention the coupling head is an integrally manufactured part of the driven part.

This reduces the number of parts in the functional attachment and increases the reliability and durability of the functional attachment.

BRIEF DESCRIPTION OF THE DRAWINGS

The above mentioned aspects and other aspects of the invention will be apparent from and elucidated with reference to the embodiments described hereinafter by way of non-limiting examples only and with reference to the schematic figures in the enclosed drawing.

DETAILED DESCRIPTION OF EMBODIMENTS

Figure 1:
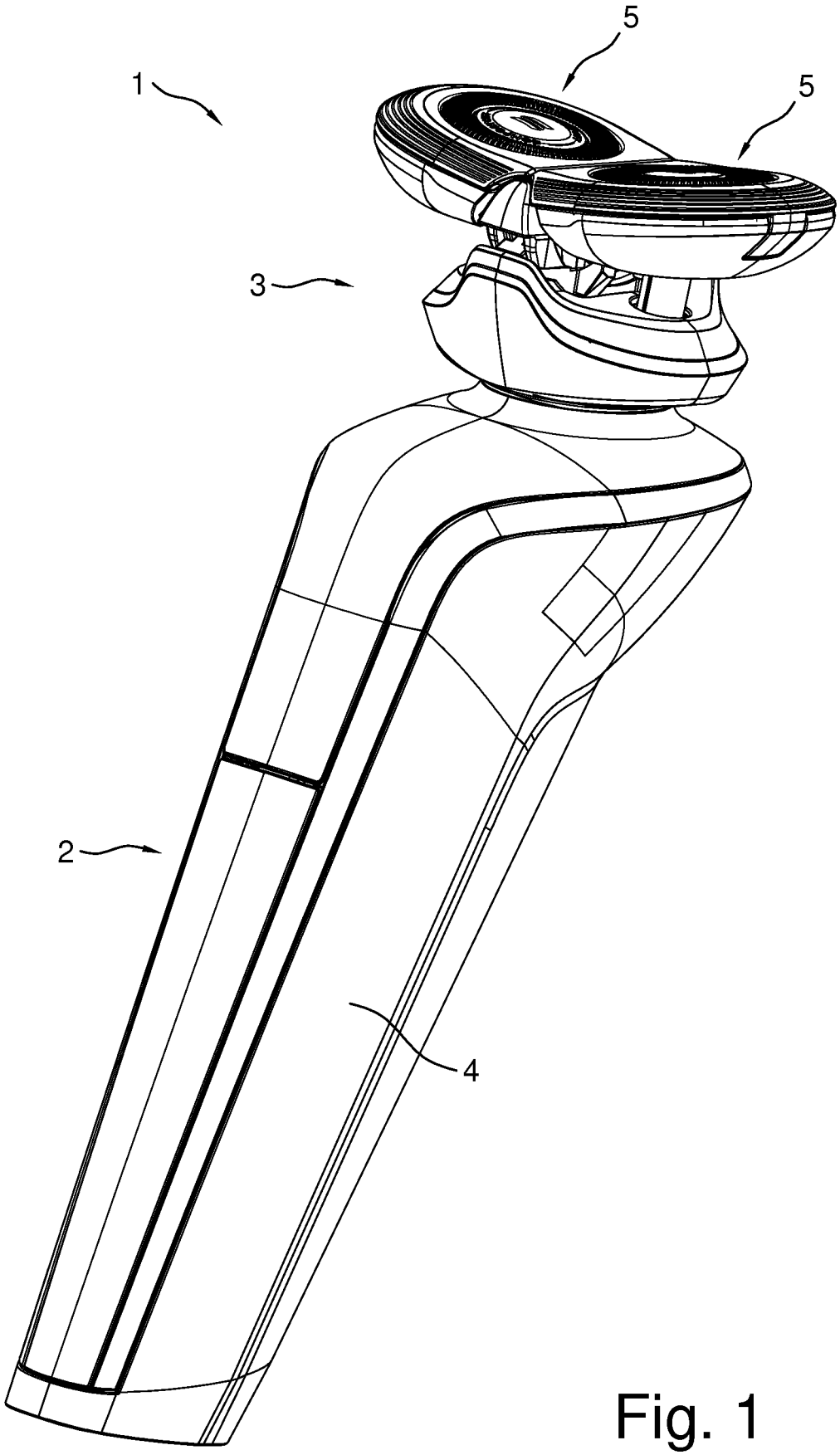
FIG. 1 shows, in a perspective view, an example of an embodiment of a hand-held appliance according to the invention.
Figure 2:
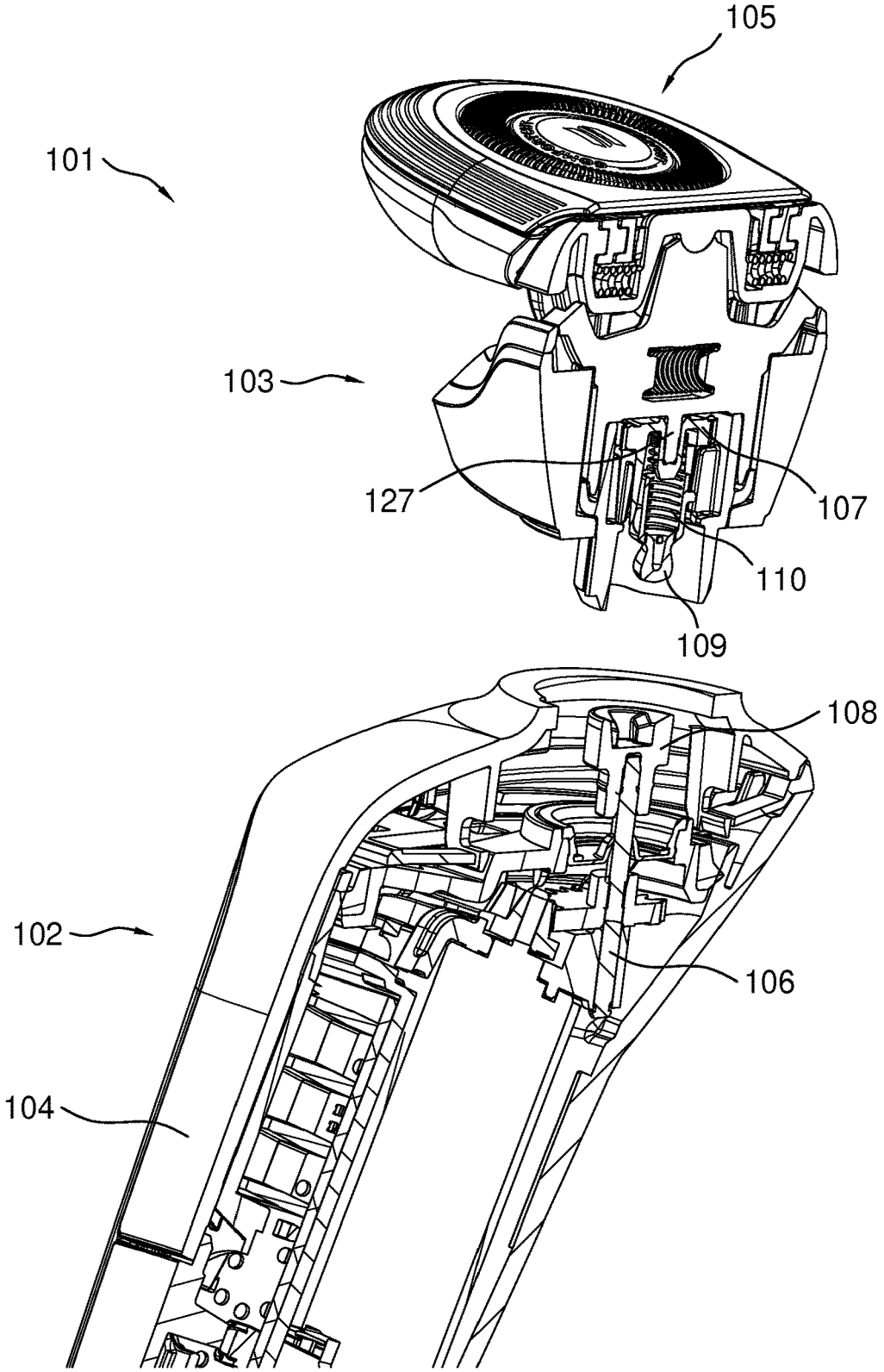
Fig. 2 (PRIOR ART)
FIG. 2 (Prior Art) shows, in cross-sectional perspective view, a hand-held appliance known from the prior art, in a condition in which the functional attachment of this known hand-held appliance has been released from the main body of this known hand-held appliance.
Figure 3A:
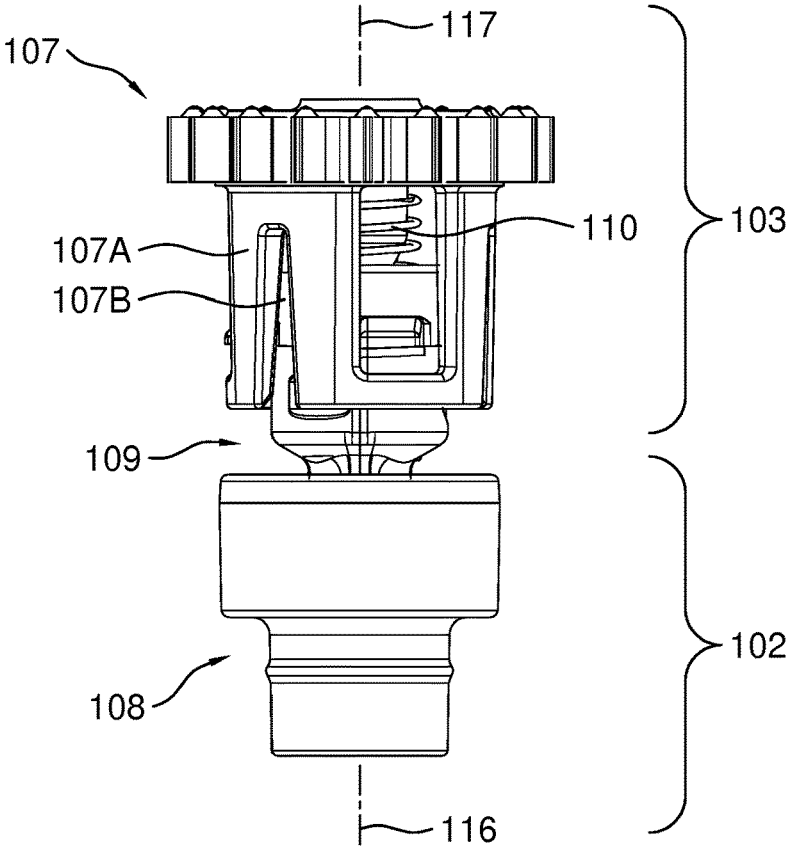
Fig. 3A (PRIOR ART)
FIG. 3A (Prior Art) separately shows, in a side view, the coupling structure of the known hand-held appliance of FIG. 2, wherein the coupling structure is in its coupled condition.
Figure 3B:
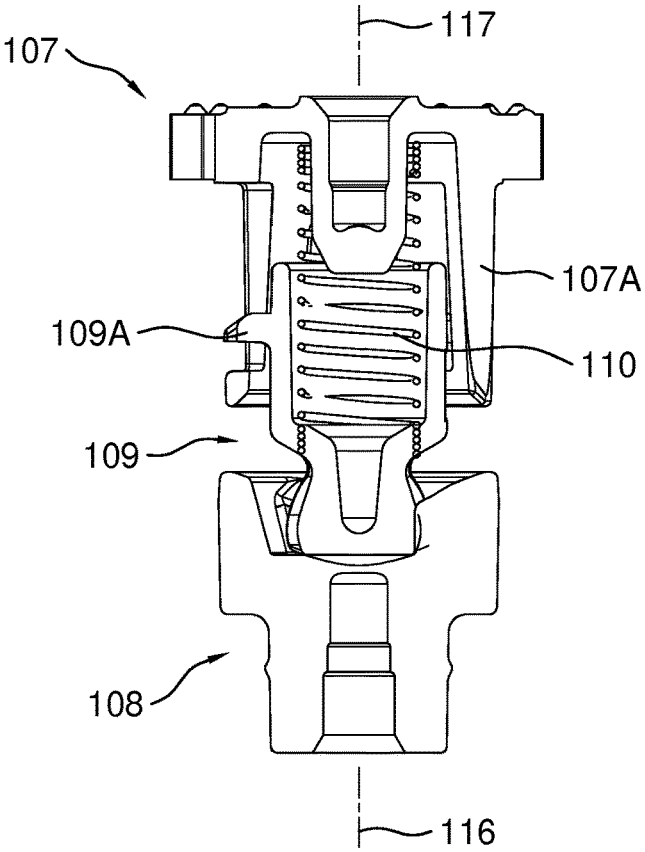
Fig. 3B (PRIOR ART)
FIG. 3B (Prior Art) shows the situation of FIG. 3A again, however this time in a cross-sectional view, which is partly a ghost view.
Figure 4B:
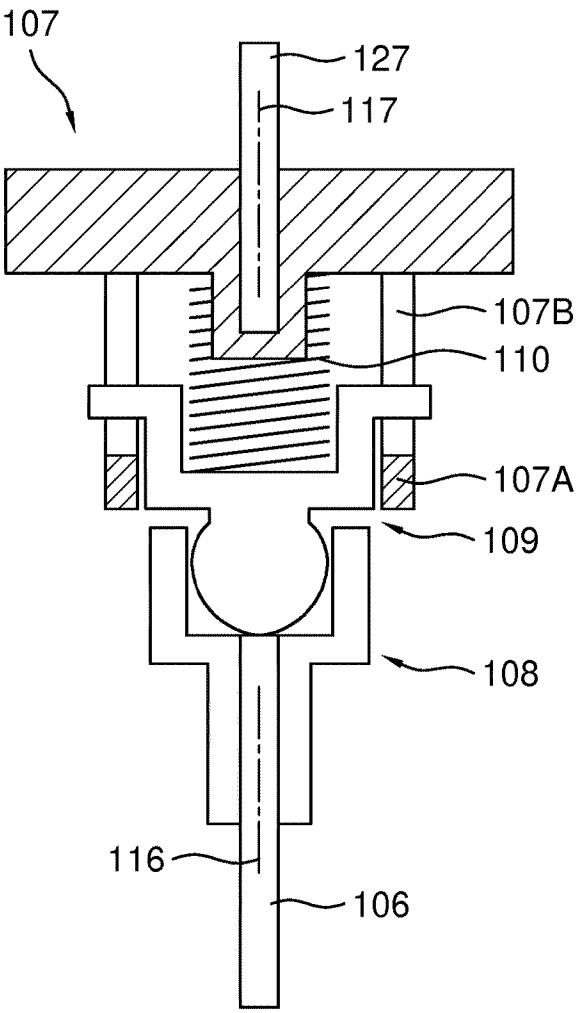
Fig. 4B (PRIOR ART)
FIG. 4B (Prior Art) shows the situation of FIG. 4A again, however this time in coupled condition of the coupling structure.
Figure 4A:
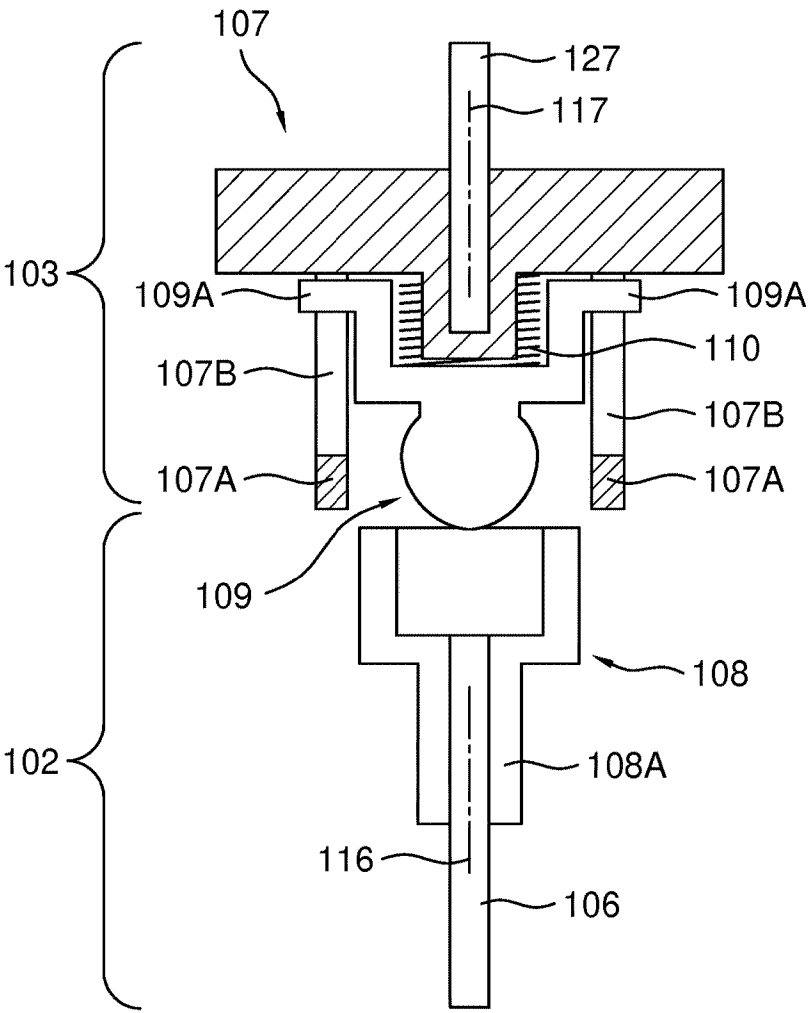
Fig. 4A (PRIOR ART)
FIG. 4A (Prior Art) shows the coupling structure of the known hand-held appliance of FIG. 2 again, in a cross-sectional partly-ghost view similar to the view of FIG. 3B, however wherein this time the view is more schematic than in FIG. 3B and wherein the coupling structure is not in coupled condition, but in uncoupled condition.

The hand-held appliance as shown in FIGS. 1, 5A-5B, 6A-6B, 7A-7B has all the features of all of the abovementioned main and preferable embodiments of the invention. The reference signs used in FIGS. 1, 5A-5B, 6A-6B, 7A-7B are referring to the abovementioned parts and aspects of the invention, as well as to related parts and aspects, in the following manner.

1 hand-held appliance
2 main body
3 functional attachment
4 hand-gripping area
5 functional structure
6 drive shaft
6A drive-shaft main-body
6B drive-shaft adapter
7 driven part
8 coupling bush
9 coupling head
10 coupling spring
16 rotation axis of drive shaft 6
17 rotation axis of driven part 7
27 pivot pin for driven part 7

Based on the above introductory description, including the brief description of the drawing figures, and based on the above-explained reference signs used in FIGS. 1, 5A-5B, 6A-6B, 7A-7B, the shown examples in FIGS. 1, 5A-5B, 6A-6B, 7A-7B are for the greatest part readily self-explanatory. The following extra explanations are given.

FIG. 1 shows the hand-held appliance 1 in its attached condition, in which the functional attachment 3 is releasably attached to the main body 2. The shown hand-held appliance 1 is a shaving device, wherein the functional structure of the functional attachment 3 comprises two hair-cutting units 5. The coupling structure of the hand-held appliance 1 comprises the coupling bush 8, the coupling head 9 and the coupling spring 10.

Figure 5A:
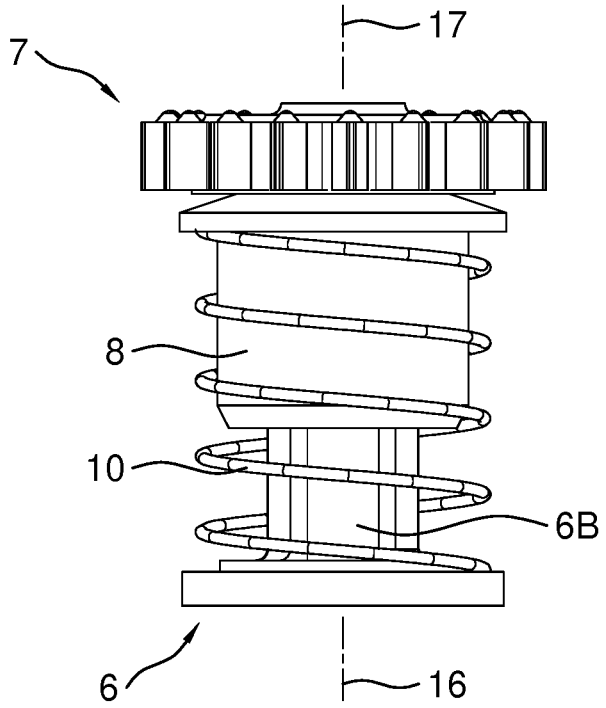
FIG. 5A separately shows, in a side view, the coupling structure of the hand-held appliance according to the invention, shown in FIG. 1, wherein the coupling structure is in its coupled condition.
Figure 5B:
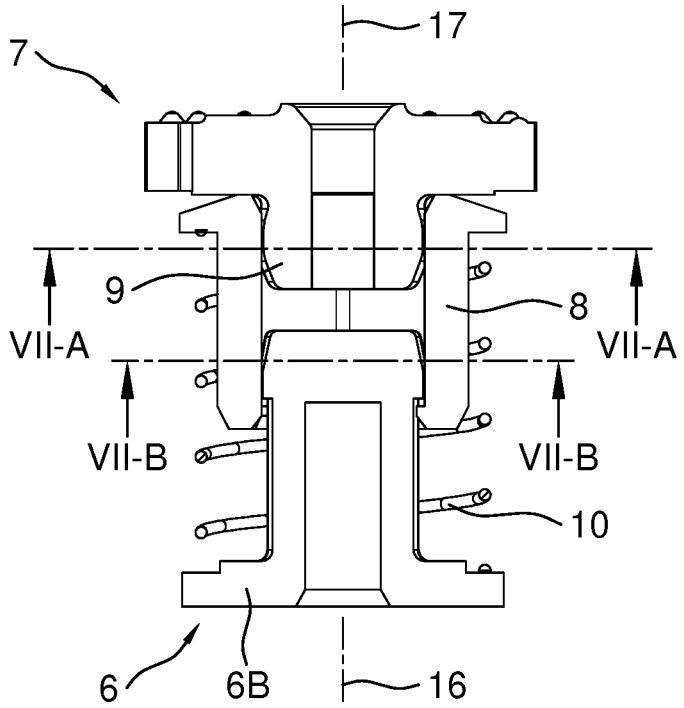
FIG. 5B shows the situation of FIG. 5A again, however this time in a cross-sectional view, which is partly a ghost view.
Figure 6B:
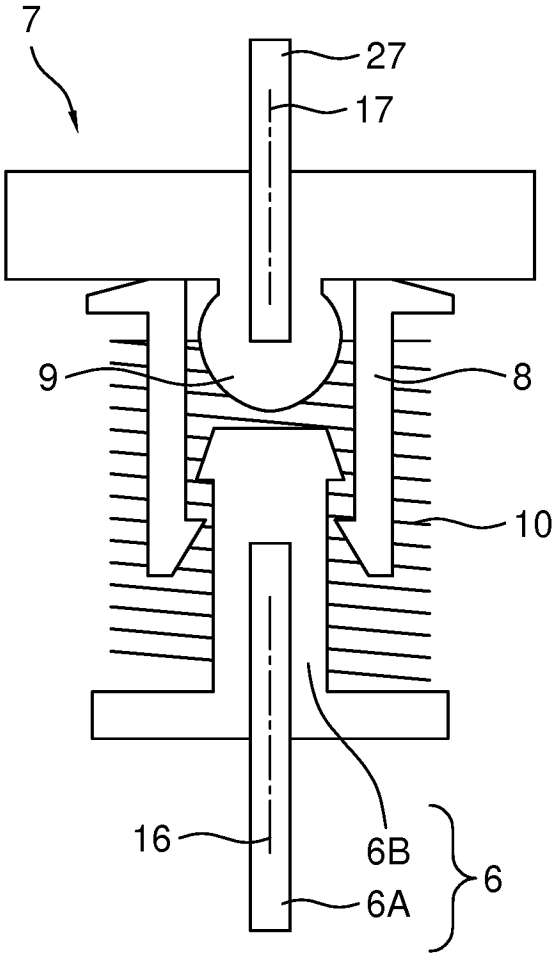
FIG. 6B shows the situation of FIG. 6A again, however this time in coupled condition of the coupling structure.
Figure 6A:
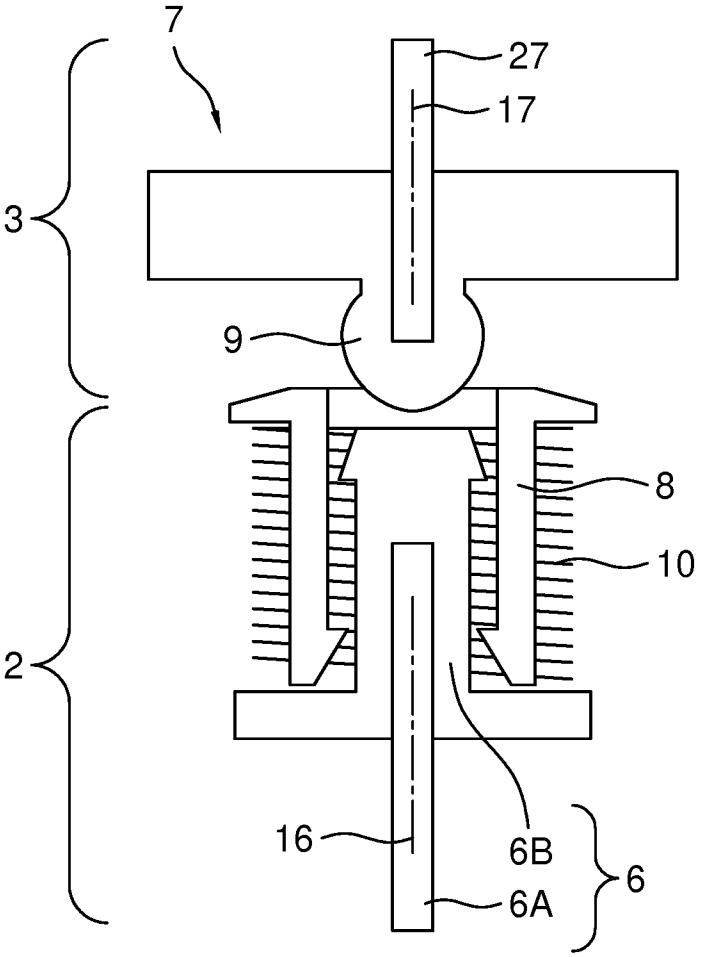
FIG. 6A shows the coupling structure of the hand-held appliance of FIG. 1 again, in a cross-sectional partly-ghost view similar to the view of FIG. 5B, however wherein this time the view is more schematic than in FIG. 5B and wherein the coupling structure is not in coupled condition, but in uncoupled condition.
Figure 7A:
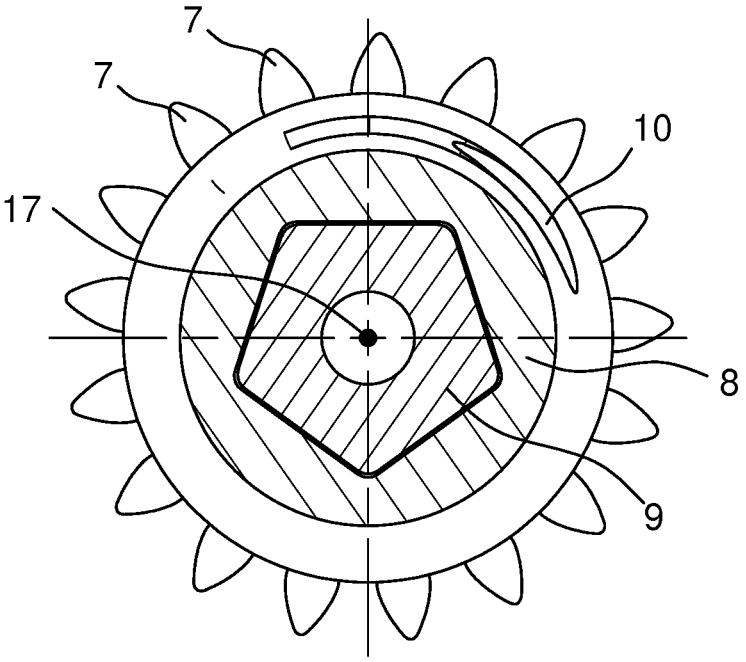
FIG. 7A is a partly-ghost view onto a cross-sectional plane, which in FIG. 5B is indicated by the viewing-direction arrows VILA.
Figure 7B:
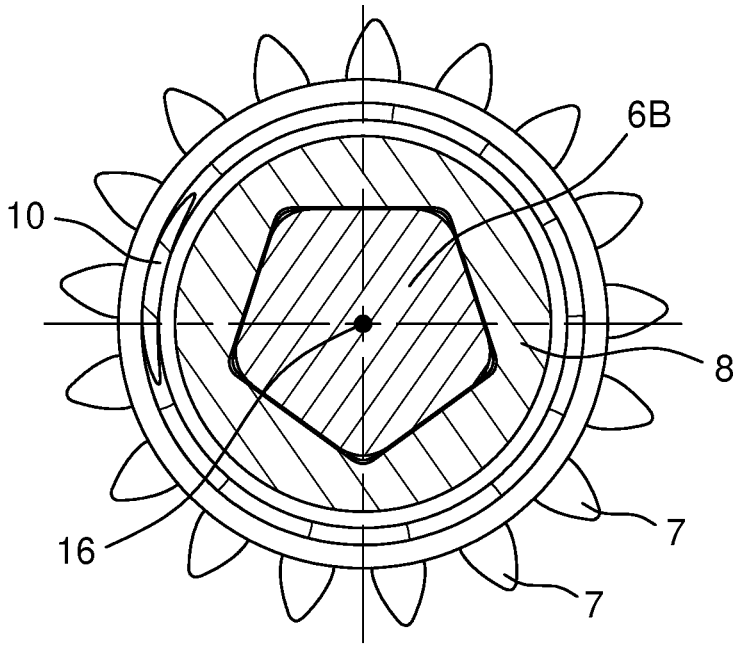
FIG. 7B is a partly-ghost view onto a cross-sectional plane, which in FIG. 5B is indicated by the viewing-direction arrows VII-B.

Reference is now made to FIGS. 5A-5B, 6A-6B, 7A-7B, while noting that FIGS. 6A-6B show the coupling structure 8, 9, 10 in a comparable, but more schematic cross-sectional view as compared to FIG. 5B.

The driven part 7 is a gear wheel, wherein the coupling head 9 is an integrally manufactured part of the gear wheel. The driven part 7 is rotatable about the rotation axis 17 in that the driven part 7 is rotatable about the pivot pin 27 (shown in FIGS. 6A-6B), whose center line functions as the rotation axis 17.

The drive shaft 6 comprises the drive-shaft main-body 6A and the drive-shaft adapter 6B, which is fixedly attached to the drive-shaft main-body 6A in a co-rotatable manner about the rotation axis 16.

The axial displaceability of the coupling bush 8 relative to the drive shaft 6 is realized in that the coupling bush 8 and the drive shaft 6 are interconnected in mutual telescoping engagement.

The coupling spring 10 is held in-between a flange of the drive-shaft adapter 6B and a flange of the coupling bush 8. Both the coupling bush 8 and the coupling spring 10 are coupled to the drive shaft 6 in a co-rotatable manner about the rotation axis 16. These co-rotatabilities are realized in that the circumference of the outer side of the drive-shaft adapter 6B has a polygonal shape, which mates with the polygonal shape of the circumference of the inner side of the coupling bush 8, as seen in cross-section transverse to the rotation axis 16 (see FIG. 5B in combination with FIG. 7B).

The coupled condition of the coupling structure 8, 9, 10 requires that the functional attachment 2 is attached to the main body 3. The coupled condition of the coupling structure 8, 9, 10 additionally requires that the coupling head 9 is at least partly inserted via an axial end of the coupling bush 8 into an interior space of the coupling bush 8, while in said interior space there is co-rotating coupling between the coupling bush 8 and the coupling head 9. In the coupling structure 8, 9, 10 said co-rotating coupling in said interior space is realized in that the circumference of the outer side of the coupling head 9 has a polygonal shape, which mates with the polygonal shape of the circumference of the inner side of the coupling bush 8, as seen in cross-section transverse to the rotation axis 17 (see FIG. 5B in combination with FIG. 7A).

In FIGS. 5A-5B the coupling structure 8, 9, 10 is in its coupled condition. Both in FIG. 6A and in FIG. 6B the functional attachment 2 is attached to the main body 3. The difference between FIG. 6A and FIG. 6B, however, is that in FIG. 6A the coupling structure 8, 9, 10 is in the uncoupled condition, while in FIG. 6B it is in the coupled condition. That is, in FIG. 6A the coupling head 9 does not yet extend into the interior space of the coupling bush 8 for co-rotating coupling between the coupling bush 8 and the coupling head 9, due to misalignment of the abovementioned mating polygonal shapes of the coupling head 9 and the coupling bush 8. In fact, FIG. 6A relates to a situation immediately after a user has attached the functional attachment 2 to the main body 3, after which the motor has not yet been started to drive the drive shaft 6. As soon as the user starts the motor, said misalignment will automatically be cancelled under influence of the coupling spring 10, which urges displacement of the coupling bush 8 towards the coupling head 9, so that the coupling head 9 will come to at least partly extend into the interior space of the coupling bush 8, whereby the coupled condition shown in FIG. 6B is obtained.

Hence, it has now been made clear that the hand-held appliance 1 according to the invention differs from the known hand-held appliance 101 of FIGS. 2, 3A-3B, 4A-4B in that for the hand-held appliance 1 according to the invention:

the coupling head 9 is axially fixed within the functional attachment 3 (instead of being axially displaceable within the functional attachment, as is the case for the coupling head 109 of the known hand-held appliance 101);

the coupling bush 8 is axially displaceable within the main body 2 (instead of being axially fixed within the main body, as is the case for the coupling bush 108 of the known hand-held appliance 101); and the coupling spring 10 is housed in the main body 2 (instead of in the functional attachment, as is the case for the coupling spring 110 of the known hand-held appliance 101).

While the invention has been described and illustrated in detail in the foregoing description and in the drawing figures, such description and illustration are to be considered exemplary and/or illustrative and not restrictive; the invention is not limited to the disclosed embodiments.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfil the functions of several items recited in the claims. For the purpose of clarity and a concise description, features are disclosed herein as part of the same or separate embodiments, however, it will be appreciated that the scope of the invention may include embodiments having combinations of all or some of the features disclosed. The mere fact that certain measures are recited in mutually different dependent claims does not indicate that a combination of these measures cannot be used to advantage. Any reference signs in the claims should not be construed as limiting the scope.

The invention claimed is:

1. A hand-held appliance comprising a main body and a functional attachment, wherein:

the hand-held appliance has an attached condition in which the functional attachment is releasably attached to the main body;

the main body houses a motor and a drive shaft and comprises a hand-gripping area for manually holding the hand-held appliance;

the functional attachment houses a driven part and a functional structure for performing a functionality of the hand-held appliance;

the hand-held appliance comprises a coupling structure for coupling the drive shaft and the driven part for mutual co-rotation;

a coupled condition of said coupling structure is defined as a condition, in which the hand-held appliance is in said attached condition, and in which the coupling structure couples the drive shaft and the driven part for mutual co-rotation;

an uncoupled condition of said coupling structure is defined as a condition, in which the coupling structure does not couple the drive shaft and the driven part for mutual co-rotation;

an operation condition of the hand-held appliance is defined as a condition, in which the coupling structure is in said coupled condition, and in which the motor drives the drive shaft, while at the same time the drive shaft drives the driven part in mutual co-rotation, while at the same time the driven part drives the functional structure of the functional attachment;

the coupling structure comprises a coupling bush, a coupling head and a coupling spring, wherein the main body houses the coupling bush, and wherein the functional attachment houses the coupling head;

the coupling bush and the drive shaft are coupled for mutual co-rotation, and the coupling head and the driven part are coupled for mutual co-rotation;

said mutual co-rotation of the drive shaft and the driven part in said operation condition of the hand-held appliance is realized in that in said coupled condition of the coupling structure the coupling head is at least partly inserted via an axial end of the coupling bush into an interior space of the coupling bush, while in said interior space there is co-rotating coupling between the coupling bush and the coupling head; and in said attached condition of the hand-held appliance, the coupling spring urges relative displacement of one of the coupling head and the coupling bush towards the other of the coupling head and the coupling bush, so as to effectuate said coupled condition from said uncoupled condition when the motor drives the drive shaft, and so as to maintain said coupled condition when the motor drives the drive shaft;

characterized in that:

within the functional attachment the coupling head has an axially fixed position relative to the driven part, as seen along a rotation axis of the driven part;

within the main body the coupling bush is axially displaceable relative to the drive shaft, as seen along a rotation axis of the drive shaft; and the main body houses the coupling spring, wherein the coupling spring urges displacement of the coupling bush relative to the drive shaft for said effectuating and said maintaining said coupled condition of the coupling structure when the motor drives the drive shaft in the attached condition of the hand-held appliance.

2. The hand-held appliance according to claim 1, wherein said axial displaceability of the coupling bush relative to the drive shaft is realized in that the coupling bush and the drive shaft are interconnected in mutual telescoping engagement.

3. The hand-held appliance according to claim 2, wherein, as seen in cross-sections transverse to the rotation axis of the drive shaft:

a first circumference of an inner side of the coupling bush has a first non-circular shape, such as for example a first polygonal shape;

a second circumference of an outer side of the drive shaft has a second non-circular shape, such as for example a second polygonal shape, wherein said second non-circular shape mates with said first non-circular shape for realizing said co-rotating coupling between the coupling bush and the drive shaft; and a third circumference of an outer side of the coupling head has a third non-circular shape, such as for example a third polygonal shape, wherein said third non-circular shape mates with said first non-circular shape for realizing said co-rotating coupling between the coupling bush and the coupling head.

4. The hand-held appliance according to claim 3, wherein said second non-circular shape is the same as said third non-circular shape.

5. The hand-held appliance according to claim 1, wherein the coupling head is an integrally manufactured part of the driven part.

* * * * *